United States Patent [19]

Calvert et al.

[11] 4,384,377

[45] May 24, 1983

[54] TUB-SHOWER BACKWALL AND SIDEWALL PANEL INTERLOCK

[75] Inventors: Scott A. Calvert; Leslie A. Bowman, both of Granville; James W. Rinehart, Toledo; Merritt W. Seymour, Sylvania, all of Ohio

[73] Assignee: Owens-Corning Fiberglas Corporation, Toledo, Ohio

[21] Appl. No.: 261,822

[22] Filed: May 8, 1981

[51] Int. Cl.[3] ..... A47K 3/08

[52] U.S. Cl. ..... 4/614; 4/612; 52/34

[58] Field of Search ..... 4/596, 599, 600, 584, 4/557, 612, 614, 607, 609, 610, 546, 613, 552, 4/595, 337; 52/34, 35, 286, 588, 593, 594

[56] References Cited

U.S. PATENT DOCUMENTS

| | | | |
|---|---|---|---|
| 3,303,620 | 2/1967 | Dawson et al. | 52/588 |
| 3,618,281 | 11/1971 | Hill et al. | 52/588 |
| 3,827,086 | 8/1974 | Seymour et al. | 4/584 |

*Primary Examiner*—Stephen Marcus
*Assistant Examiner*—Kenneth S. Putnam
*Attorney, Agent, or Firm*—Ronald C. Hudgens; Philip R. Cloutier; Paul J. Rose

[57] ABSTRACT

Backwall and sidewall panels for assembly with a bathtub in the forming of a shower enclosure are molded with integral interlockable portions respectively thereon whereby the sidewall panel can be assembled with the backwall panel to provide firm engagement therebetween by the interengaging of the interlockable portions with each other.

6 Claims, 4 Drawing Figures

TUB-SHOWER BACKWALL AND SIDEWALL PANEL INTERLOCK

TECHNICAL FIELD

This invention relates generally to molded glass fiber reinforced plastic panels which are assembled to line the walls above a bathtub in a bathtub recess and thus form a shower enclosure, and more particularly to an improved method of securing sidewall panels to a backwall panel in such construction.

BACKGROUND ART

U.S. Pat. No. 3,827,086 discloses a tub-shower. FIG. 6 shows a joint between the backwall panel and a sidewall panel. The joint is described at Col. 5, lines 12—31. There is a channel 54 for caulking and there are holes 55 for screw fasteners. Many times the screw fasteners did not hold and leakage could occur through the joint.

U.S. Pat. No. 4,180,874 refers at Col. 8, lines 44–47, to "metal clips or latches" for securing the panels together. These latches were similar to those on metal toolboxes. The provision for the securing of the two latch parts of each latch respectively to the two panels was expensive, involving thickened molded portions on the panels for the reception of threaded metal inserts. Many times an installer did not attach the latch parts by threading screws into the metal inserts, and leakage through the joint could occur.

DISCLOSURE OF INVENTION

In accordance with the invention, mating interlocking portions are molded on the panels as integral parts respectively thereof. As a result, no screws or fastening latches are required to secure the molded panels together. In addition, drainage means is provided at the joints and no caulking is required.

BRIEF DESCRIPTION OF DRAWINGS

The invention is described in detail hereinafter with reference to the accompanying drawings in which.

BEST MODE OF CARRYING OUT THE INVENTION

Figure 1:
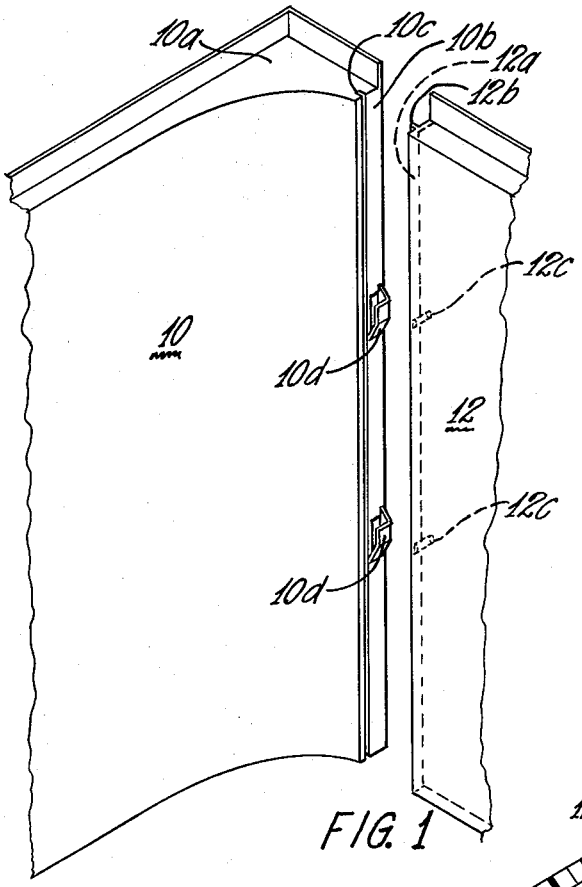
FIG. 1 is a fragmentary exploded perspective view showing a portion of a backwall panel and a portion of a sidewall panel, both constructed in accordance with the invention.
Figure 2:
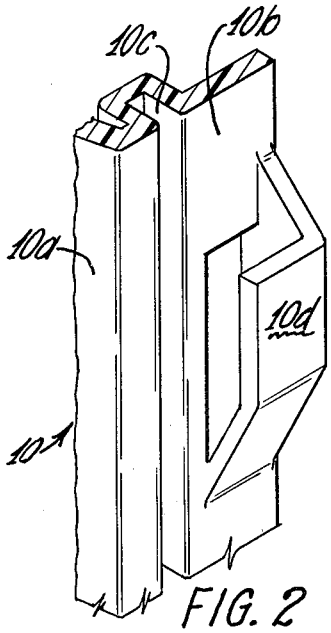
FIG. 2 is an enlarged fragmentary perspective view showing one of the female interlock portions of the backwall panel of FIG. 1.

With respect to the drawings, FIG. 1 shows a portion of a molded glass fiber reinforced plastic backwall panel 10 and a portion of a molded glass fiber reinforced plastic sidewall panel 12. The backwall panel 10 is contoured to include a pair of corner portions **10*a* disposed respectively at opposite ends, only one being shown. The corner portion 10*a* presents a face 10*b* adapted to abut an edge face 12*a* of the sidewall panel 12 when the two panels are assembled. The face 10*b* is provided with a vertical groove 10*c*. A tongue portion 12*b* projects from the face 12*a* and extends vertically for reception in the groove 10*c***.

Figure 4:
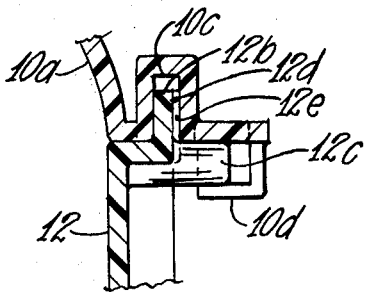
FIG. 4 is an enlarged fragmentary horizontal sectional view showing one of the interlock portions respectively on the backwall and sidewall panels of FIG. 1 in assembled relationship.

The backwall panel 10 is provided with a pair of female interlock or pocket portions **10*d* in vertically spaced relationship on the face 10*b*, and the sidewall panel 12 is provided with a pair of male interlock or outwardly extending dowel portions 12*c*. The female interlock or pocket portions 10*d* are in the form of pockets open at the top and along an inner side. Once the backwall panel 10 is in place, the sidewall panel 12 is assembled therewith by raising it so that the dowel portions 12*c* are above the respective pocket portions 10*d*, inserting the tongue portion 12*b* in the groove 10*c*, and pushing the sidewall panel 12 downwardly to engage the dowel portions 12*c* in the pocket portions 10*d* as shown in FIG. 4 and thereby firmly engage the face 12*a* against the face 10*b* due to jamming action by the pocket portions 10*d* on the dowel portions 12*c***.

The groove **10*c* is deeper than the projection length of the tongue portion 12*b*. The bottom of the groove 10*c*** thus forms a drainage channel for any water which seeps through the joint by wicking action, and any such water is directed into a soap dish recess (not shown) for eventual drainage into the tub.

Figure 3:
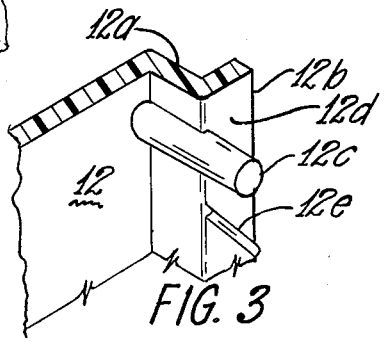
FIG. 3 is an enlarged fragmentary perspective view showing one of the male interlock portions of the sidewall panel of FIG. 1.

An outer side surface **12*d* of the tongue portion 12*b* is provided with a plurality of vertically spaced inclined ridges 12*e*, one of which is best shown in FIG. 3. The ridges 12*e* along with the tongue portion 12*b* have an interference fit with the groove 10*c* to effect firm engagement between the other side of the tongue portion 12*b* opposite the ridges 12*e* and the corresponding side of the groove 10*c*. A tight fit between the panels 10 and 12 is thus provided in an L-shaped configuration. The ridges 12*e* are inclined downwardly toward the bottom of the groove 10*c*** whereby any moisture collecting on them is also drained harmlessly away. The joint requires no caulking.

A similar but inversely formed sidewall panel (not shown) is similarly joined to the other end portion of the backwall panel 10.

Various modifications may be made in the structure shown and described without departing from the spirit and scope of the invention.

We claim:

1. A molded backwall panel and a molded sidewall panel for assembly with a bathtub in the forming of a shower enclosure, the panels having interlockable portions integrally molded respectively thereon whereby the sidewall panel can be assembled with the backwall panel to enclose a space and provide firm engagement between the panels by the interengaging of said interlockable portions with each other, the interlockable portions including pocket portions disposed on one of the panels and each being open on a vertical inner side adjacent the enclosed space of a completed enclosure and also at a top of said pocket portion, and outwardly extending dowel portions on the other of the panels, the dowel portions being engageable respectively in the pocket portions upon relative vertical movement between the panels.

2. Panels as claimed in claim 1 wherein the pocket portions are on the backwall panel and the outwardly extending dowel portions are on the sidewall panel, the dowel portions being engageable respectively in the pocket portions upon downward movement of the sidewall panel.

3. Panels as claimed in claim 1 wherein the interlockable portions also include a vertically extending groove in one of the panels and a vertically extending tongue portion on the other of the panels, the tongue portion being disposed in the groove when the panels are interlocked.

4. A molded backwall panel and a molded sidewall panel for assembly with a bathtub in the forming of a shower enclosure, the panels having a pair of dowel-and-pocket connections therebetween for jamming a first pair of mating surfaces into firm engagement with each other and also a tongue-and-groove connection therebetween with means on a tongue portion of the tongue-and-groove connection for jamming a second pair of mating surfaces into firm engagement with each other, the second pair of mating surfaces extending at right angles to the first pair.

5. Panels as claimed in claim 4 wherein the means on the tongue portion comprises spaced ridges.

6. Panels as claimed in claim 5 wherein the ridges on the tongue portion are downwardly inclined toward the bottom of a groove of the tongue-and-groove connection.

* * * * *